United States Patent [19]

Kaldenbach

[11] 4,100,873

[45] Jul. 18, 1978

[54] FLOATING CRAFT

[75] Inventor: Willem Paul Kaldenbach, Delft, Netherlands

[73] Assignee: Netherlands Offshore Company (Nederlandse Maatschappij voor Werken Buitengaats) B.V., Delft, Netherlands

[21] Appl. No.: 737,581

[22] Filed: Nov. 1, 1976

[30] Foreign Application Priority Data

Nov. 14, 1975 [GB] United Kingdom ..... 47133/75

[51] Int. Cl.[2] ..... B63B 43/06

[52] U.S. Cl. ..... 114/125; 49/280

[58] Field of Search ..... 114/125, 121, 74 R, 114/74 A, 73, 72, 116, 117, 118; 49/280; 212/3

[56] References Cited

U.S. PATENT DOCUMENTS

| | | | |
|---|---|---|---|
| 860,492 | 7/1907 | Mehrtens | 114/125 |
| 1,488,067 | 3/1924 | Schneider | 114/125 X |
| 3,038,432 | 6/1962 | Goldman | 114/72 |
| 3,213,632 | 10/1965 | Valk et al. | 114/74 A X |
| 3,318,276 | 5/1967 | Nemec | 114/72 X |
| 3,366,087 | 1/1968 | Hilliard | 114/125 |
| 3,635,182 | 1/1972 | Paffett | 114/125 |
| 3,797,440 | 3/1974 | Pangalila | 114/121 |

*Primary Examiner*—Barry L. Kelmachter
*Attorney, Agent, or Firm*—Brisebois & Kruger

[57] ABSTRACT

A floating vessel having a crane for lifting heavy weights comprises tanks having relatively large openings below the water-line which openings can be closed in a substantially water-tight manner to vary the shape of at least that part of the vessel which is below the water-line.

1 Claim, 9 Drawing Figures

FLOATING CRAFT

This invention relates to floating craft or vessels, such as ships, barges, dredgers and floating cranes, and to means for and a method of regulating the roll and/or pitch period and stability of the craft according to the prevailing sea conditions and the function to be performed by the craft.

More particularly, the invention is concerned with a craft, particularly a ship, which is equipped with a crane for lifting heavy weights and which can also be used for other purposes, such as for laying of undersea pipe lines for gas or oil. While performing such functions the craft is usually anchored by a plurality of cables.

An object of the invention is to provide means for regulating the transverse and/or longitudinal metacentric height of the craft, which are the distances between the metacentres and the centre of gravity of the craft and are the values which produce the up-righting moments of the craft and are also factors relevant to its roll and/or pitch period.

The load which can be lifted by a crane installed on a ship depends upon the shape of the hull below the water-line. For example, a vessel with a displacement of about 43,000 tons and a beam of about 26 m is only able to lift a load of about 800 short tons at a 90 ft. radius, while not producing a list exceeding 5°. By increasing the beam to 36 m, a load of 2,000 short tons can be lifted at a radius of 90 ft. while again not exceeding a list of 5°. The transverse stability of a craft increases with the cube of its beam. However, by increasing the beam dimension, the transverse metacentric height is increased and produces a corresponding reduction in the roll period of the vessel. If resonance should occur between the low periodicity of a relatively slight swell and the low roll period of the vessel, excessive rolling occurs making it impossible to use the crane for lifting in what would be regarded as a calm sea. If the shape of the hull is varied by reducing the beam dimension of the ship the transverse metacentric height is reduced thereby changing its roll period to bring it out of resonance with the wave motion. Also by reducing the effective length dimension of the ship the longitudinal metacentric height is reduced thereby changing its pitch period to bring it out of resonance with the wave motion.

The metacentric heights are changed according to the invention, by providing the floating vessel with compartments or tanks having relatively large openings below the waterline, and by providing doors or like closures for closing each of said openings in a substantially watertight manner in order to vary the shape of at least that part of the vessel beneath the waterline.

Thus, in one embodiment in which the tanks are side tanks extending along at least part of the opposite sides of the vessel, while the doors are closed, the effective beam dimension of the vessel extends for the overall width including the side tanks, whereas when the doors are opened, the effective beam dimension of the vessel is reduced by the widths of the two side tanks which reduces the transverse metacentric height and correspondingly increases the roll period of the vessel. Thus, in another embodiment or in the same as above in which the tanks are bow or stern tanks, while the doors are closed, the effective length dimension of the vessel extends for the overall length including the bow and stern tanks, whereas when the doors are opened, the effective length dimension of the vessel is reduced and the pitch period of the vessel is correspondingly increased.

Alternatively or additionally to the side, bow and stern tanks of the vessel may have tanks extending along at least a part of its bottom. The side tanks may be built on to the outside of the hull of a ship as wing tanks or may be incorporated in the hull along each side thereof, and of a depth to extend both above and below the waterline, the openings being provided in the bottom wall of the wing side tanks or the built-in side tanks. Side, bow and stern tanks may be open or openable to atmosphere. The tanks may be equipped with power-operated doors or the like for closing the openings. Preferably, the tank along each side of the and/or along the bottom of the vessel is divided lengthwise of the vessel into several separate watertight compartments, or comprises several separate tanks arranged end-to-end, the doors of the separate compartments or tanks being selectively opened or closed so that only some or all of the various compartments or tanks can be opened to the outside water or closed to provide the increased beam widths. Preferably, the tank near the bow and the stern and/or along the bottom of the vessel is divided beamwise of the vessel into several separate watertight compartments, or comprises several separate tanks arranged side-by-side, the doors of the separate compartments or tanks being selectively opened or closed so that only some or all of the various compartments or tanks can be opened to the outside water or closed to provide the increased effective length.

Preferably, means are also provided for pumping the tanks or compartments dry or otherwise ejecting the water therefrom when the doors are closed so as to improve the buoyancy of the vessel.

The openings in the bottom of the tanks are relatively large and preferably occupy between 30% and 50% of the area, in plan, of the tanks. The flow of water entering and leaving a tank through their openings, when the doors are open, is restricted somewhat by the surrounding wall surfaces of the bottom of the tank, thereby producing a damping effect on the rolling or pitching of the ship and improving its stability by reducing the amplitude of rolling or pitching.

The vessel is provided with control means for selectively opening and closing the doors of the respective compartments or tanks and for selectively pumping dry or ejecting water from the various compartments or tanks of which the doors are closed.

In order that the invention may be more clearly understood, reference will now be made to the accompanying drawings in which.

Figure 2:
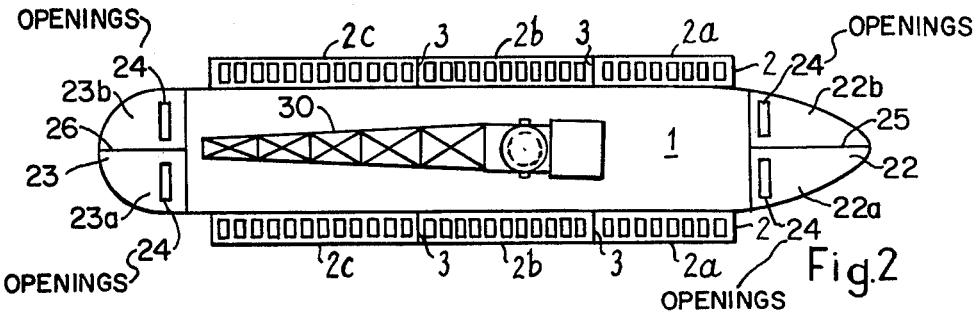
FIG. 2 is a plan view of of the ship with the top portion of the tanks being removed and the tank openings being shown.
Figure 1:
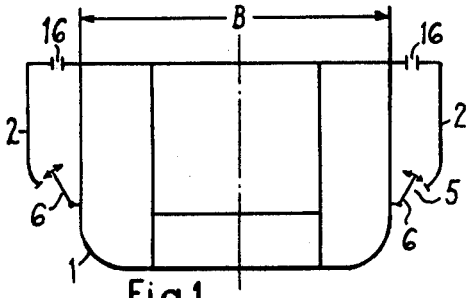
FIG. 1 is a transverse section through a ship according to the invention.

FIGS. 1 to 4 represent a vessel 1 which has been the subject of experimental tests. It is a converted oil tanker having an initial beam width B of about 26.5 m and a displacement of approximately 43,000 tons and modified by the addition of wing side tanks 2 along the greater part of each side of the vessel. Each side tank 2 is about 4.75 m wide and divided into three separate watertight compartments 2*a*, 2*b*, 2*c* by bulkheads 3. The side wing tanks are secured along the upper portions of the sides of the hull and are of a sufficient depth to extend both above and below the waterline even with a list of about 5°. The bottom wall portions 4 of the tanks are provided with a series of relatively large openings 5 shown as of rectangular shape. The openings may be about 2 m × 3 m and are closable by doors 6 hinged at 7 and movable from the closed and open positions shown in full and dotted lines respectively in FIG. 3 by means of a hydraulic cylinder 8. The doors 6, when closed, seal against gaskets 9 in a watertight fashion and are held locked in the closed position by two pairs of bolts 10*a*, 10*b* which are pivotted at 11*a*, 11*b* and are moved in pairs by two hydraulic cylinders 12 to engage beneath cam retainers 13*a* 13*b* (see FIG. 4). When a door has been opened, it is locked in the open position by the upper bolts 10*a* being actuated by their respective cylinders 12 to engage with retainers 14 secured to the structure of the tanks (see FIG. 3).

The deck portions 15 of the compartments of the tanks are provided with openings 16 for exhausting air from the side tanks during admission of water therein when the doors are open. Some of these openings are fitted with manhole covers (not shown) giving access to the ladders 17, 18 down to the lower regions of the tanks. Others of these openings are provided with closure members to prevent dirt and loose objects from falling into the tanks while permitting the exhausting of air as above mentioned.

Pumps 21 are provided for pumping the side tank compartments dry when the doors of the relevant compartment are closed. The pumps may be specially provided for this purpose and may be located in the side tank compartments or, alternatively, the pump may be mounted inboard of the hull and also be used for pumping water into or from the various ballast tanks of the vessel. In order to admit water to the side tank compartments before commencing to open the doors 6, valves 19 are provided in the wall of the compartment and operable by control means 20 above the deck 15. Unless water is admitted above the doors before they are opened, the rapid inflow of water through the openings 5 is liable to cause damage to the sealing gaskets 9.

Operation of the doors and door locking means is effected by a hydraulic control system. The main hydraulic cylinders and the lock cylinders of each compartment are selectively actuated by two 3-position control valves respectively, each control valve in one position admitting hydraulic pressure fluid to one end of its associated cylinders while exhausting the other ends, in a second position admitting hydraulic pressure fluid to said other ends of its associated cylinders and exhausting the opposite ends, and in the third position disconnecting the hydraulic pressure fluid supply from both ends of the cylinders. The sequence of operation for opening the doors, after opening the valves 19, is preferably as follows.

1. Apply closing pressure to main cylinders 8
2. Apply unlocking pressure to lock cylinders 12
3. Apply opening pressure to main cylinders 8
4. Apply locking pressure to lock cylinders 12 to lock doors in open position
5. Disconnect pressure from main cylinders 8
6. Disconnect pressure from lock cylinders 12

For closing the doors, the above operations are preferably carried out in the following order - 3, 2, 1, 4(to lock doors in closed position), 5, 6.

As above mentioned, the beam of the oil tanker before conversion was 26.5 m and the side tanks had a width of 4.75 m each, so that the overall effective beam of the vessel when the doors of the side tanks are closed was 36 m. With all the doors closed and all the side tanks pumped dry, the crane 30, the boom of which was counterbalanced with a weight of 1,600 short tons, was capable of lifting a load of about 2,000 short tons at a radius of 90 ft. without the ship listing more than 5°. The roll period, without a load on the crane hook was about 10 seconds. If the wave motion of the sea is in resonance with the roll period, excessive rolling occurs and this can be appreciably reduced and in fact substantially eliminated by opening the doors of one or more of the side compartments. This results in the load which the crane can lift without exceeding a list of 5° being reduced but, nevertheless, it is still possible to keep the vessel performing lifting operations even if the loads which can be lifted have to be somewhat reduced during these periods. Thus, by opening the doors of compartments 2*a*, the load which could be lifted was approximately 1,500 short tons at a radius of 90 ft. With the doors of more side tanks opened, the load which could be lifted was further reduced.

The invention also makes it possible to use the vessel for the laying of undersea pipes for oil or gas. These are generally steel pipes of substantial diameter and are welded up on a structure along one side of the vessel and lowered into the sea, for example, as described in British Specification Nos. 1,348,487 and 1,330,091. The pipes are naturally springy and with a vessel having a beam of 36 m, with a roll period of the order of 9–10 secs, the section of the pipe supported on the side of the vessel is unable to follow the roll period with consequent possibility of the pipe and support structure banging together and causing fracture. By opening the doors 6, the roll period can be increased, thereby enabling the pipe to follow the ship's movement, the amplitude of rolling being simultaneously reduced by the damping effect of the water passing in and out of the side tanks through the openings 5 which represent an area of 30–50% of the floor area of the tanks. Thus, the risk of damage to the pipe and support structure is substantially eliminated and the dual purpose vessel is enabled to effect pipe laying in sea conditions which might otherwise make it dangerous so to do.

Figure 5:
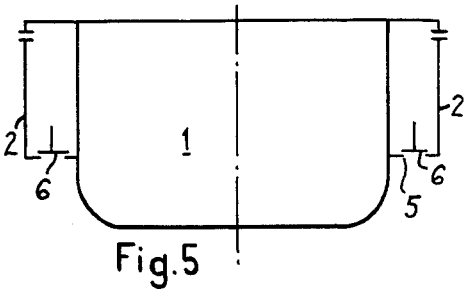
FIGS. 5 to 9 show cross-sections of modified ship constructions.
Figure 6:
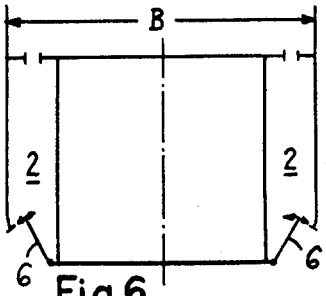
Figure 7:
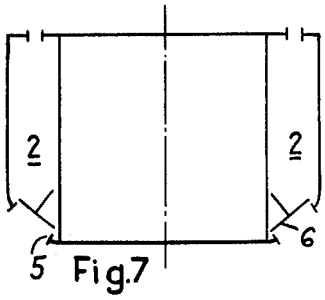
Figure 8:
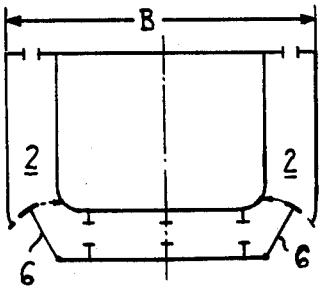
Figure 9:
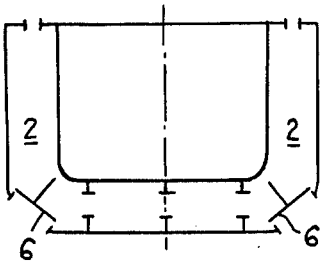
Figure 3:
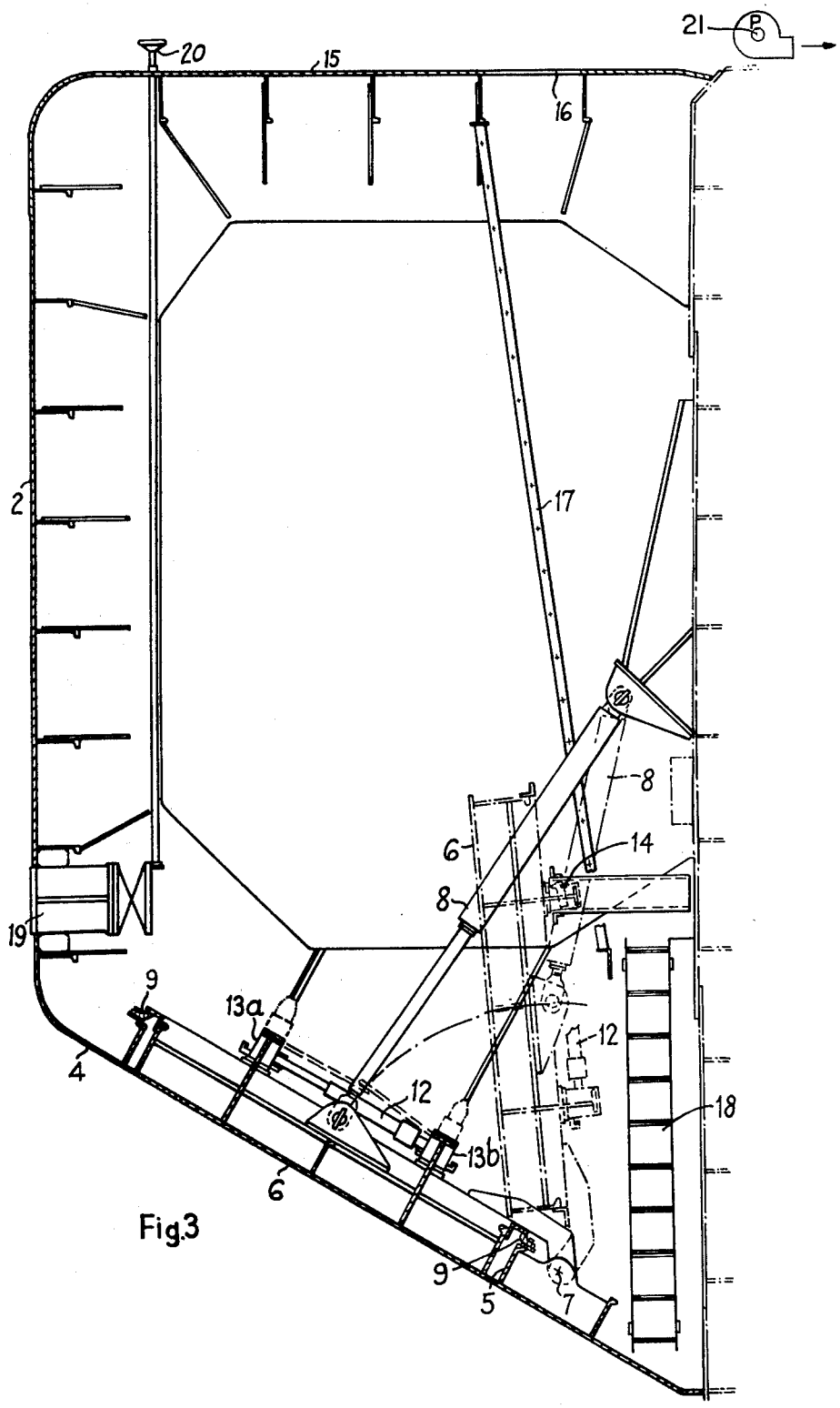
FIG. 3 is an enlarged cross-section through a wing side tank of FIG. 1 showing the door operating mechanism.
Figure 4:
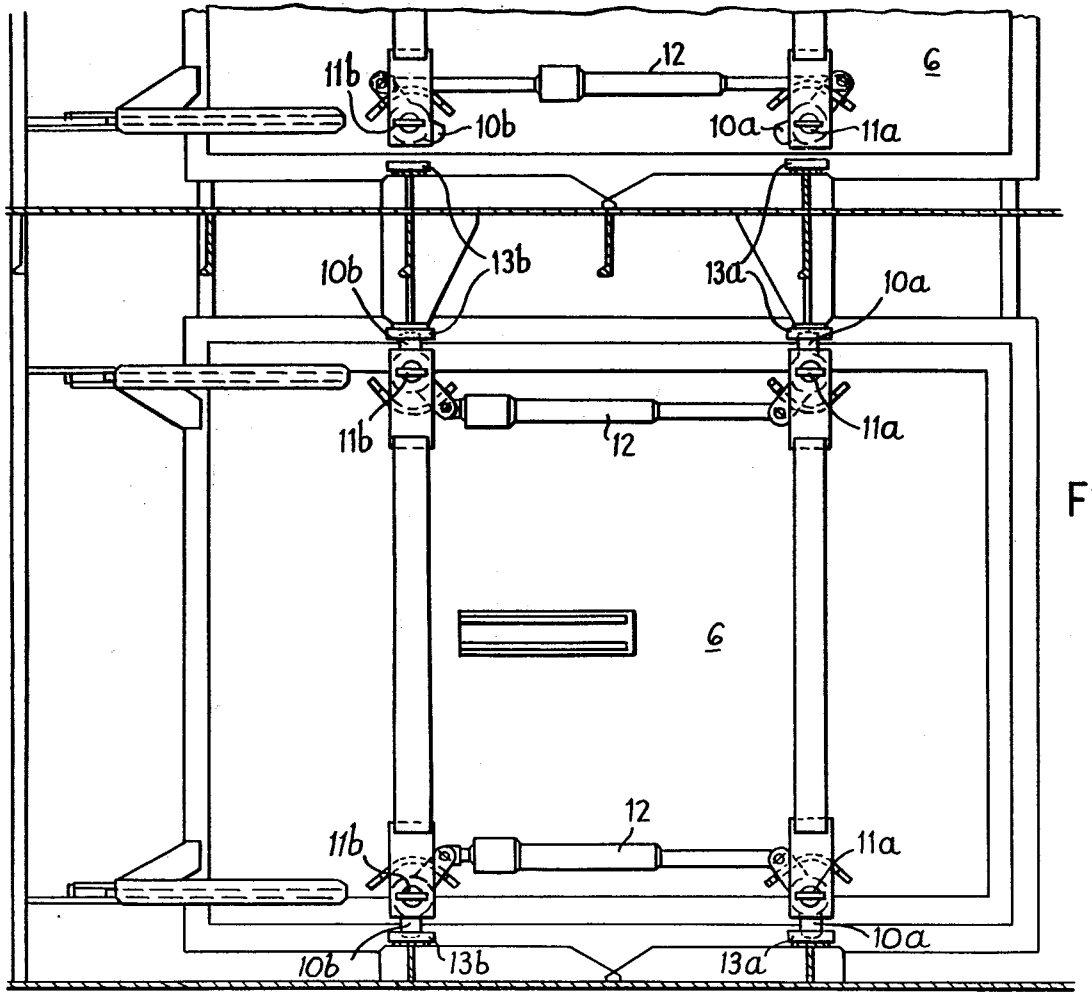
FIG. 4 is a view looking at the backs of two adjacent doors to show the locking arrangement.

FIG. 2 also shows diagrammatically how the vessel can be provided with bow and stern tanks, 22, 23 respectively, with closable openings 24 for changing the effective length dimension of the vessel and thus its pitch period. The bow and stern tanks are divided beamwise into separate compartments 22*a*, 22*b* and 23*a*, 23*b* by bulkheads 25, 26 respectively FIGS. 5 to 9 show cross-sections of modified constructions of vessel with side tanks for enabling the regulation of the roll period to be achieved according to the method hereinbefore described. FIG. 5 shows an alternative form of wing tanks with the bottom wall substantially horizontal. In FIGS. 6 and 7, the side tanks 2 are disposed within the hull structure and extend to the bottom of the vessel. FIGS. 8 and 9 again show further constructions comprising a wide beam ship with a double skin hull which defines side tanks and bottom tanks. By opening the doors 6 in the outer skin, the beam is reduced. Alternatively or additionally the space or compartment below the inner shell can also be used to alter the shape of the hull and thus the metacentric heights of the ship. Instead of the doors 6 being hinged as shown in FIGS. 1 to 4, 6 and 8, they may be arranged as shown in FIGS. 5, 7 and 9.

I claim:

1. A floating vessel equipped with at least one crane for lifting heavy loads and comprising a plurality of tank means each having wall means defining at least part of the outer surface of the vessel which is in contact with the sea, each said tank means being located at least in part below the water-line of the vessel, means defining a plurality of large openings in said wall means of each of said tank means, each of said openings serving to connect the interior of its associated tank means with the sea and being so disposed below the said water-line and of such large size relative to the sizes of the tank means as to permit the sea water to flow substantially freely into and out of the associated tank means in accordance with the motion of the sea, closure means for each said opening, means mounting each said closure means for movement relative to its associated opening between a closed position in which the closure means closes its associated opening in a substantially water-tight manner and an open position, means for actuating each said closure means between its said closed and open positions and vice versa, whereby to change at least one of the roll and pitch periods of the vessel and wherein each closure means comprises a door pivotally mounted for movement within its associated tank means, between its closed position in sealing relation with the means defining its associated opening and its open position, said actuating means comprises hydraulic cylinder means for moving said door between said positions, and hydraulically actuated locking means on said door operable to lock the door in both its closed and open position.

* * * * *